US006660119B2

(12) United States Patent
Allen et al.

(10) Patent No.: US 6,660,119 B2
(45) Date of Patent: Dec. 9, 2003

(54) PRODUCING A LAMINATED SCRAPBOOK PAGE

(75) Inventors: Loretta E. Allen, Hilton, NY (US); Dale F. McIntyre, Honeoye Falls, NY (US); Joseph A. Manico, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 161 days.

(21) Appl. No.: 09/877,429

(22) Filed: Jun. 8, 2001

(65) Prior Publication Data

US 2002/0195189 A1 Dec. 26, 2002

(51) Int. Cl.[7] ..... B42D 15/00

(52) U.S. Cl. ..... 156/226; 156/227; 156/252; 156/256; 281/38; 402/79

(58) Field of Search ..... 156/256, 227, 156/263, 252, 217, 226; 281/31, 38; 402/79

(56) References Cited

U.S. PATENT DOCUMENTS

| | | | | |
|---|---|---|---|---|
| 4,419,837 A | * | 12/1983 | Meeker | 281/38 |
| 5,257,823 A | * | 11/1993 | Colvin, Jr. et al. | 283/117 |
| 6,004,061 A | * | 12/1999 | Manico et al. | 281/38 |
| 2002/0020092 A1 | * | 2/2002 | Kurka | 40/537 |

* cited by examiner

*Primary Examiner*—Jeff H. Aftergut
*Assistant Examiner*—Barbara J. Musser
(74) *Attorney, Agent, or Firm*—Raymond L. Owens

(57) ABSTRACT

A method of making a laminated scrapbook page including providing a filler sheet which is adapted to be folded and laminated to provide the scrapbook page, providing one or more visual images on at least one medium, providing indicia associated with the filler sheet to be able to receive the visual image(s), folding such indicia provided filler sheet, laminating the indicia provided folded filler sheet and mounting the visual images in such indicia of the filler sheet to provide the page of the scrapbook, and laminating the scrapbook page formed in step d).

4 Claims, 9 Drawing Sheets

PRODUCING A LAMINATED SCRAPBOOK PAGE

CROSS REFERENCE TO RELATED APPLICATIONS

Reference is made to commonly assigned U.S. patent application Ser. Nos. 09/845,589 filed Apr. 30, 2001, "Forming a Scrapbook Page With Images of Different Characteristics" by Dale F. McIntyre et al., the disclosure of which is incorporated herein by reference.

FIELD OF THE INVENTION

The present invention relates to forming a scrapbook page, which can be inserted into a scrapbook.

BACKGROUND OF THE INVENTION

A scrapbook is a collection of scrapbook pages, each of which is a unique collection of at least photographs, paper crafts and journaling. In general, each scrapbook page or a group of pages are based on a theme, and all of the components that make up that page(s) are in context with the theme. For instance, a scrapbook page having a "Holiday" theme would comprise photographs taken during that holiday, and page embellishments depicting the holiday. Page embellishments can be, to name a few, a Christmas tree cut out of green construction paper, a purchased die cut, a holiday rubber stamp, or a pre-printed sticker. In addition, the person making the scrapbook page would record information (who, when, etc.) about the holiday in the form of journaling on the page. All of the above mentioned components are arranged in an aesthetically pleasing manner on a filler sheet normally provided with the scrapbook. These filler sheets are typically plain white or black heavy weight papers, and the page components are typically glued in place. The finished scrapbook page is then inserted into a scrapbook.

A purpose of making a scrapbook vs. simply putting pictures in a photo album is to create a unique, personalized family heirloom that tells a story and will be cherished for a lifetime, and perhaps passed on to the next generation. The task of creating a personalized scrapbook provides benefit to those participating in this craft as well as the recipient of the completed scrapbook.

Novice scrapbookers will often look to others for inspiration when organizing a new page layout, and experienced scrapbookers will share their scrapbook page layouts for creative inspiration, and because they are a source of pride for the creator. Also, many scrapbook magazines show themed page layouts with a description on how to assemble a page, and the materials needed to get the desired results.

The scrapbook business has grown over the past several years. Today there are scrapbook specialty stores, magazines devoted to the craft, and a plurality of websites offering on-line merchandise sales and creative tips. The type of merchandise available in this market segment has grown substantially. Today, a person can purchase scrapbook specialty items including scissors to cut a variety of patterns, pre-printed patterned paper and paper in all colors of the rainbow, rubber stamps, stickers, templates, stencils, die cuts, specialty pens and markers, specialty adhesives, and die punches to name a few. On the other hand, the type of still photograph included in a scrapbook has gone relatively unchanged for over 100 years.

One problem with the current filler sheet normally supplied with scrapbooks is that they are typically plain white or black heavy weight papers. Users often purchase numerous extra page embellishments in order to create the finished personalized look they want. Another problem is that the embellishments that are purchased are of stock content, meaning that they do not contain personalized content.

With the advent of digital imaging, still photographs can take on a whole new look. Even if the original picture was captured with an analog camera, the picture can be scanned to create a digital copy of the original photograph. Once a picture is in digital form, users can create digitally enhanced photographs. Other items of interest that are enabled by digital imaging are scrapbook filler sheets and page embellishments that are printed using personalized content.

Kodak Picture Page™ is a recent development from the Eastman Kodak Company. The product is an arrangement of user provided digital images and text that are printed on a sheet of photographic media. The images are arranged such that when the media is folded in half, a two-sided page is formed having images on both sides. An adhesive is applied to the non-image bearing side of the media forming a finished laminated page. This page will typically have a 3-hole punch added so that it can be inserted into the owner's traditional 3-ring binder photo album. It should be noted that there exists a variety of binding styles besides the traditional ring binder. Most commonly, an expandable post-bound binder available from Dalle Book Co., or an expandable strap binder available from Creative Memories™.

While this product provides a valuable service for people who store their photographs in a photo album, it does not benefit those who create scrapbooks. The product's creativeness is limited because it lacks the ability to let the user crop, mat, and add other page embellishments, which makes a scrapbook into a distinctive personal heirloom.

SUMMARY OF THE INVENTION

It is therefore an object of the present invention to provide an improved way of producing a laminated scrapbook page having a selective binder system.

It is another object of the present invention to provide a method of producing a laminated scrapbook page kit.

These objects are achieved by a method of making the laminated scrapbook page, comprising the steps of:

a) providing a filler sheet which is adapted to be folded and laminated to provide the scrapbook page;

b) providing one or more visual images on at least one medium;

c) providing indicia associated with the filler sheet to be able to receive the visual image(s);

d) folding such indicia provided filler sheet and mounting the visual images in such indicia of the filler sheet to provide the page of the scrapbook;

e) laminating the scrapbook page formed in step d); and f) forming the appropriate binder attachment.

ADVANTAGES

It is an advantage of the present invention that users of scrapbooks can make their own personalized laminated scrapbook pages which can be inserted into a scrapbook having varying binder systems. This product offers the user the ability to use their own images to create the folded filler sheet(s), modify the filler sheets, mount visual images on the folded filler sheet, laminate the folded portions together, and attach the appropriate binder attachment to provide the scrapbook page. A feature of the invention is that image-receiving indicia can be formed by modifying a filler sheet thereby eliminating the need to use adhesives. By folding the filler sheet, there exists an "inside" in or on which certain image-receiving indicia can be formed or made. Image-receiving indicia made in accordance of the present invention can hold special appeal to a scrapbooker permitting them to use his/her creativity to create a scrapbook page of distinction.

DETAILED DESCRIPTION OF THE INVENTION

Figure 1A:
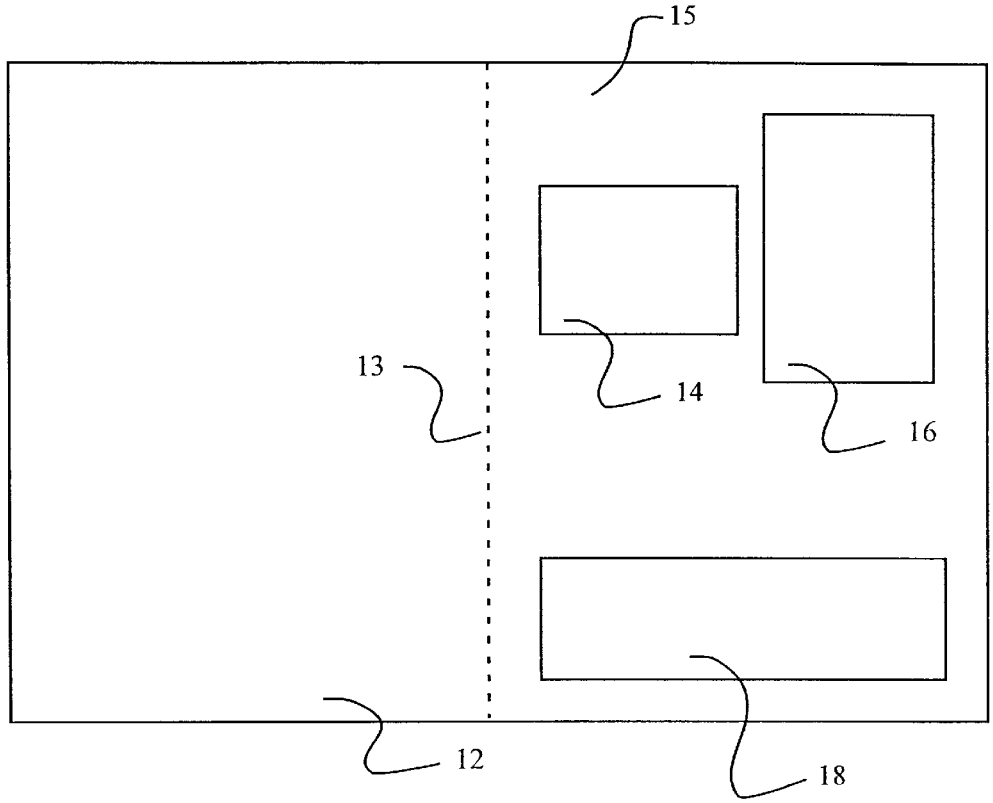
FIG. 1A depicts the components of a first kit which can be used to form a laminated scrapbook page in accordance with the present invention.
Figure 1A:
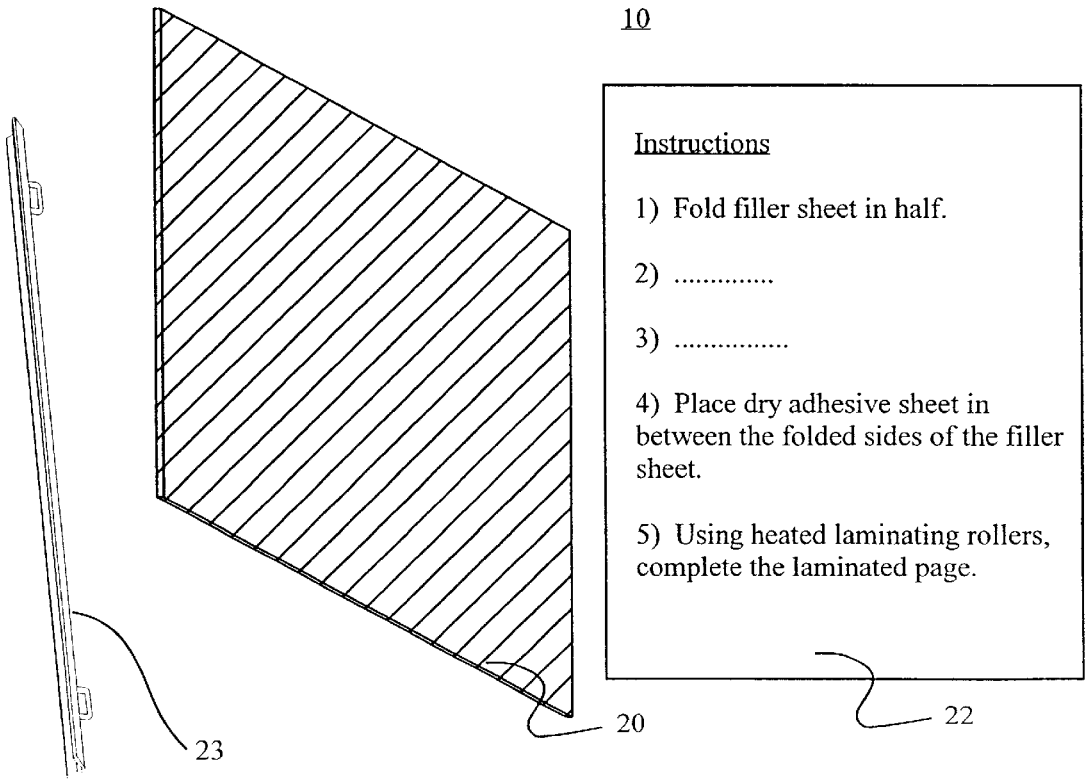

Referring to FIG. 1A, a first kit 10 for producing a laminated scrapbook page is shown. The first kit 10 includes a filler sheet 12 onto which a user can affix visual images formed on a medium, adhesive material(s) 20, an instruction sheet 22, and an alternate binder attachment 23. The medium can be photographic paper or an ink receiving medium for bearing an ink image. The filler sheet 12 typically has a front image bearing surface 15, and a back non image bearing surface (not shown). The front image bearing surface 15 of filler sheet 12 can be blank, or printed with stock images 14, 16, and 18 as shown. These stock images 14, 16, and 18 can be part of a theme that coordinates with the visual images (not shown) the user intends to affix to the filler sheet 12, and can be provided by a service provider 96 as will be discussed with respect to FIG. 4. The visual images can be affixed using several methods, most commonly by using a photographic adhesive or double-sided tape.

As described in the instruction sheet 22, the filler sheet 12 is intended to be folded along a fold line 13 with the image bearing surface 15 to the outside. Optionally, the filler sheet 12 can be supplied pre-folded in the kit 10. In the folded state there exists a front side having an image-bearing surface and a non image-bearing surface, and a back side having an image-bearing surface and a non image-bearing surface. The instruction sheet 22 also sets forth how to apply the adhesive material 20 which can be in the form of a dry sheet and sized to be equal to or slightly less than the overall dimensions of the folded filler sheet 12. To laminate the folded filler sheet 12, instruction sheet 22 instructs the user to apply the adhesive material 20 to the non image-bearing surfaces of the front and back sides of the folded filler sheet 12 so that the laminated folded sheet is now a scrapbook page. If the scrapbook page is to be inserted into a scrapbook having a ring binder, the user is instructed to punch appropriate holes along one edge using a commonly available hole punch device. If the scrapbook page is to be inserted into a scrapbook having a post bound binder, the user is instructed to trim the scrapbook page to the appropriate size, then insert the scrapbook page into a page protector usually provided with the post bound binder. If the scrapbook page is to be inserted into a scrapbook having a strap binder, then the user is instructed to determine the appropriate binder system, and mount the included alternate binder attachment 23 along one edge if necessary. The alternate binder attachment 23 can be mounted using any one of many well know methods. For instance, the alternate binder attachment 23 can be supplied with an adhesive portion having a protective release layer. In this instance, the user is instructed to simply remove the protective release layer and position the alternate binder attachment 23 appropriately before securing in place. The alternate binder attachment 23 is provided to adapt the laminated scrapbook page to any number of binder systems having varying mounting methods. Although one type of binder has been shown and described, other types of binders will suggest themselves to those skilled in the art. The result is a durable, two-sided laminated scrapbook page which is adapted to fit into a scrapbook having a number of varying binder systems.

Alternately, instead of the separate instruction sheet 22, instructions can be printed on the non image bearing side of filler sheet 12, or on the sheet of adhesive material 12.

Figure 1B:
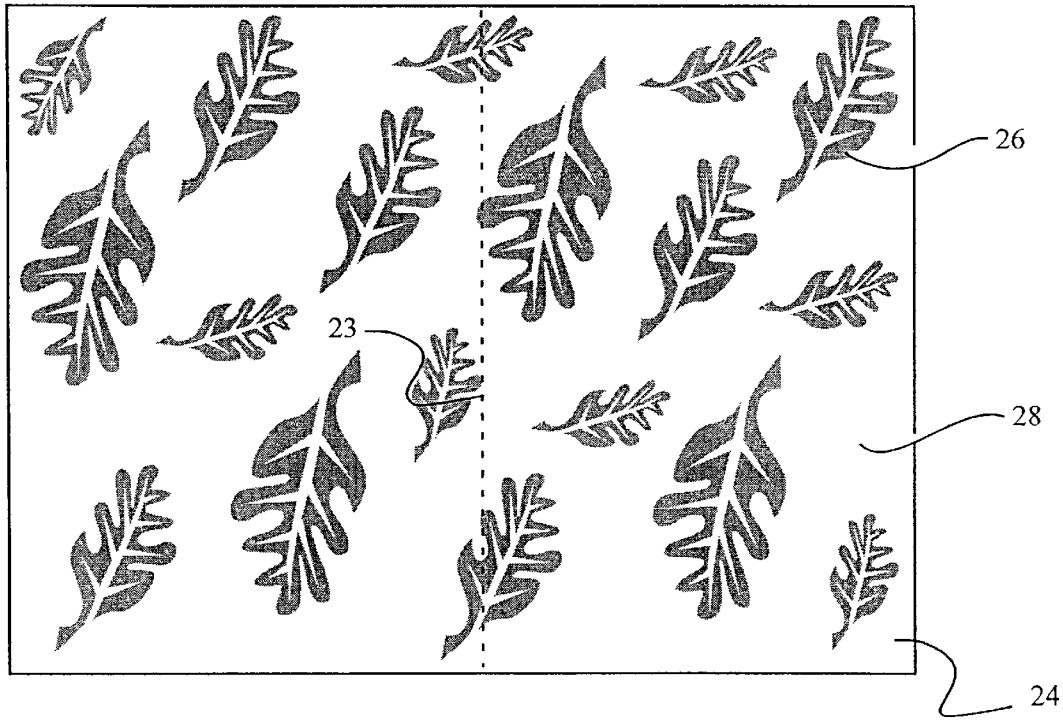
FIG. 1B depicts a second kit for forming a laminated scrapbook page.
Figure 1B:
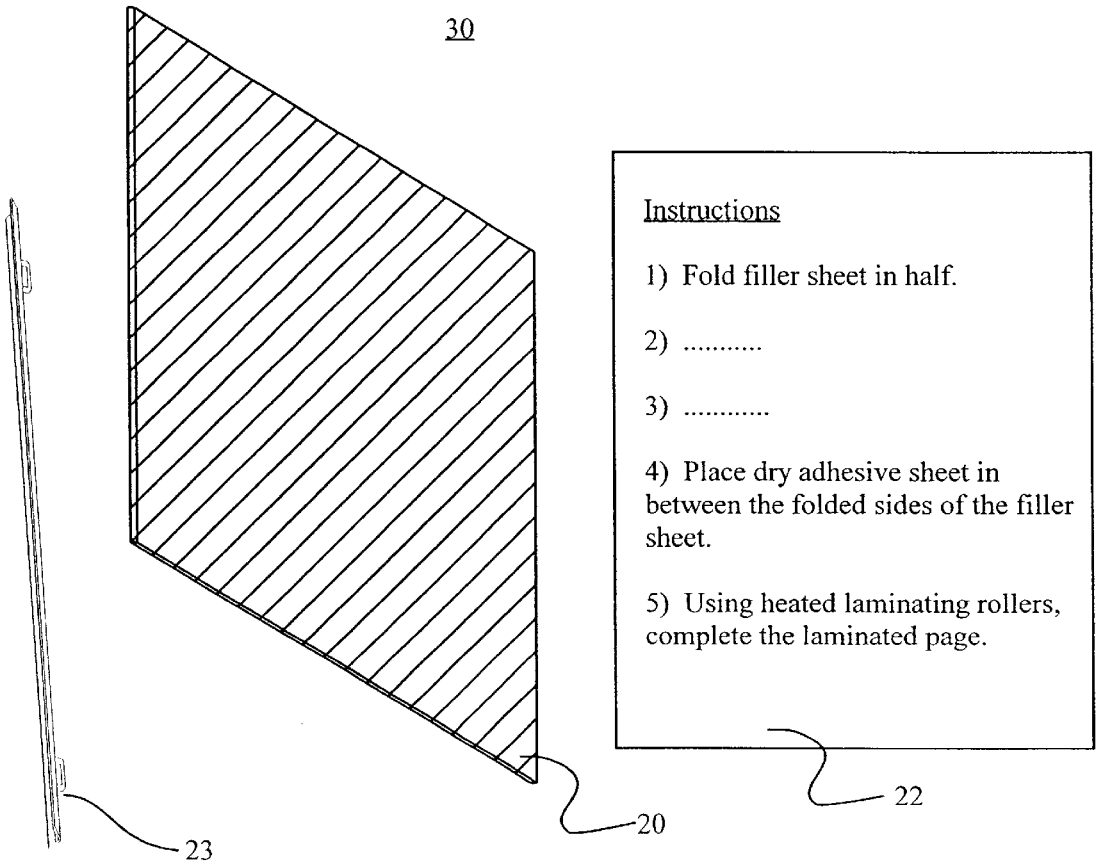
Figure 4:
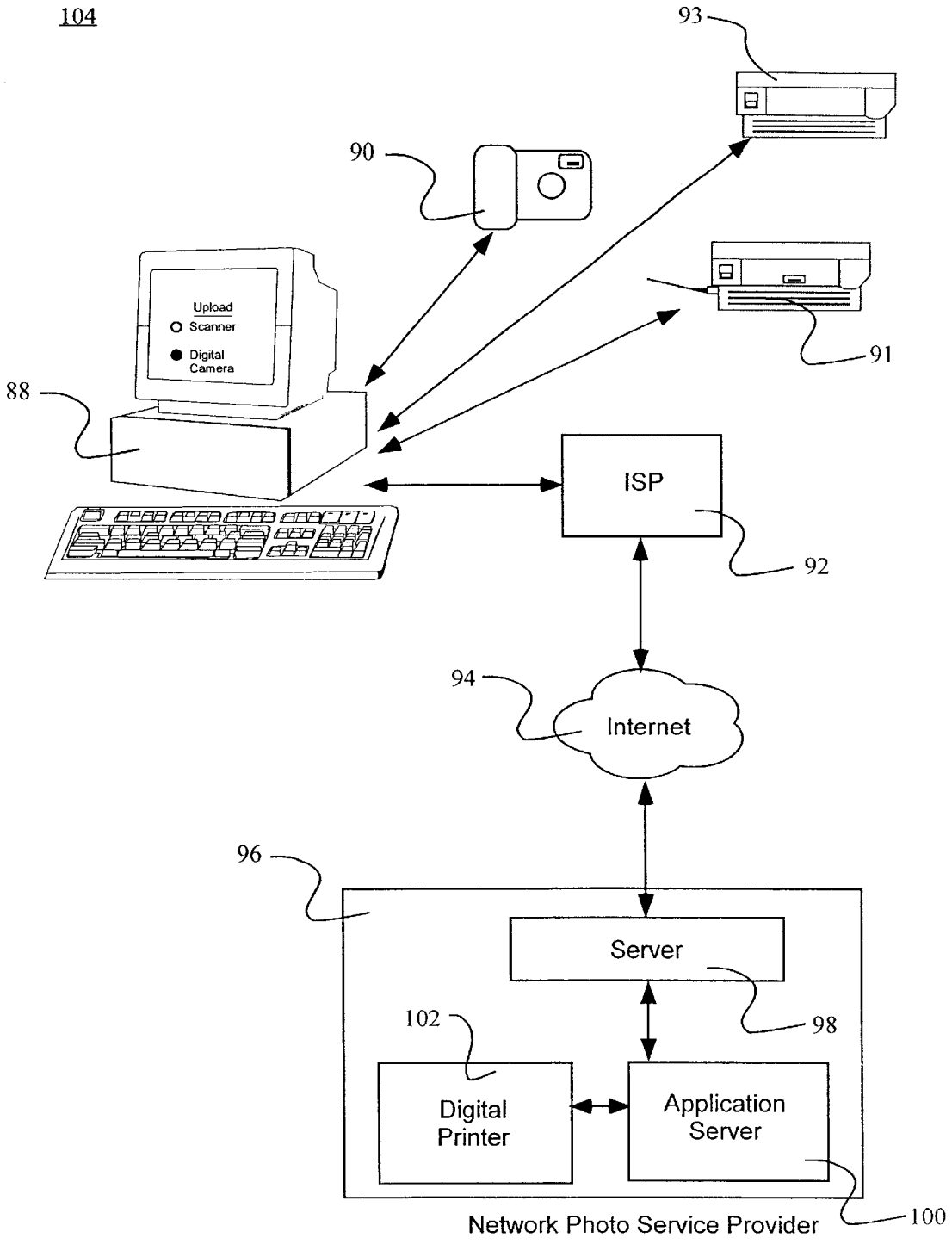
FIG. 4 is a schematic showing the use of the Internet as a channel in the practice of the present invention.

FIG. 1B shows a second kit 30 which is similar to kit 10 of FIG. 1A. Second kit 30 includes a filler sheet 24, adhesive material(s) 20, instruction sheet 22, and alternate binder attachment 23. In this embodiment, an image bearing surface 28 of the filler sheet 24 is shown printed with user selected or provided personalized background image(s). The personalized background image 26 can come from many different sources. For example, a user interested in producing a scrapbook page having a new baby theme could provide his/her baby blanket pattern to create the personalized background image 26 printed on the filler sheet 24. To create this personalized background image 26 on the filler sheet 24, a digital image is required. A digital camera 90 or a scanner 93, as shown in FIG. 4, can be used to capture the digital image for use by the service provider 96 in producing the filler sheet 24 of the second kit 30.

As described in the instruction sheet 22, the filler sheet 24 is intended to be folded along a fold line 23 with the image bearing surface 28 to the outside. Optionally, the filler sheet 12 can be supplied pre-folded in the kit 30. The instruction sheet 22 also sets forth how to apply the adhesive material 20 which can be in the form of a dry sheet and sized to be equal to or slightly less than the overall dimensions of the folded filler sheet 24. To laminate filler sheet 24, instruction sheet 22 instructs the user to apply the adhesive material 20 to the non image-bearing surfaces of the front and back sides of the folded filler sheet 24 so that it can be used as a scrapbook page. The user forms the appropriate binder attachment as described in FIG. 1A, and the result is a durable, two-sided laminated scrapbook page.

Figure 2A:
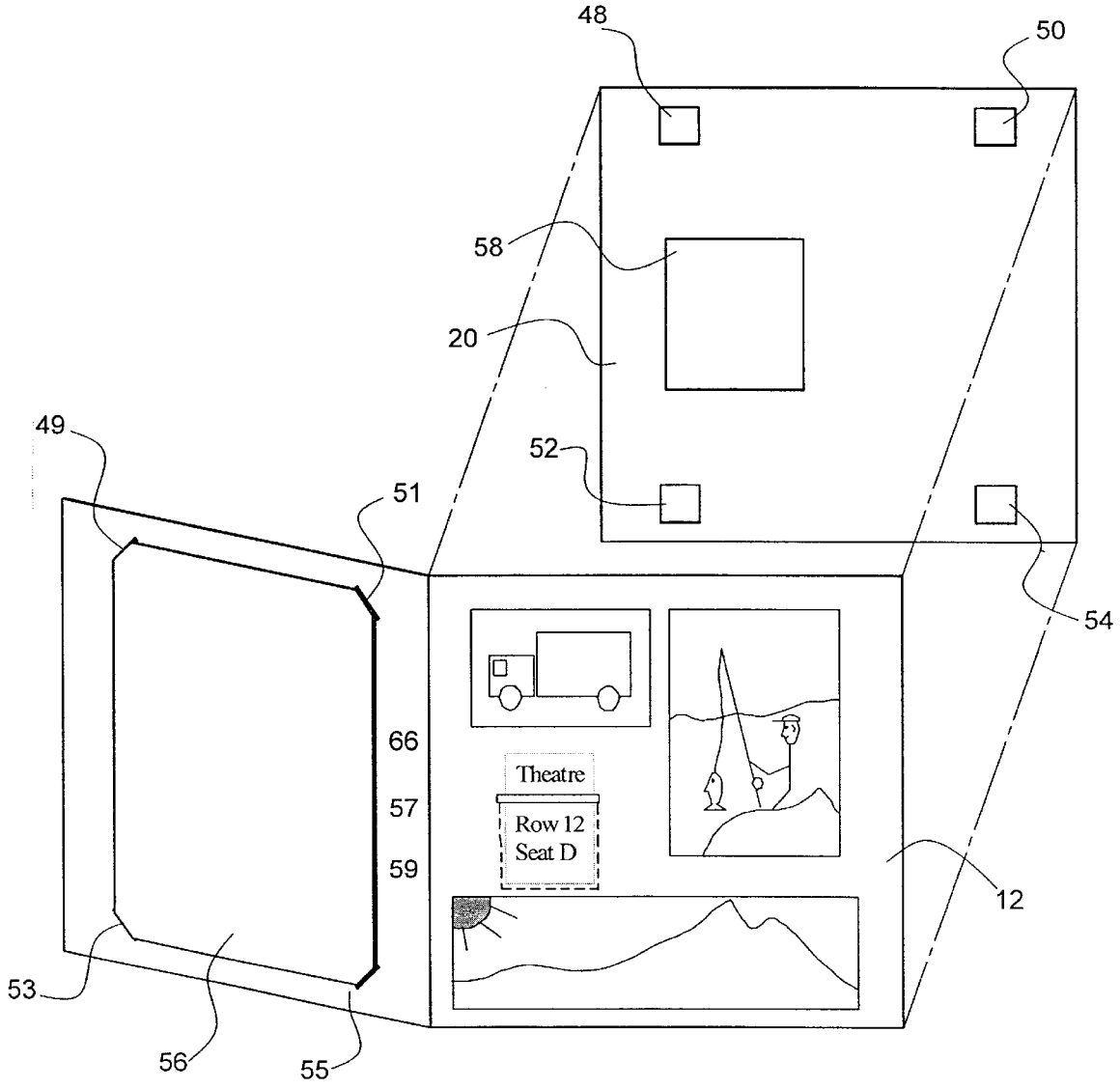
FIG. 2A depicts, in exploded view, a partially finished laminated scrapbook page formed from either a first or second kit, with a folded filler sheet having user defined indicia.

FIG. 2A shows a partially finished laminated scrapbook page formed from either the first or second kits. We will now discuss in detail a method for finishing the laminated scrapbook page. For brevity, we will only consider the first kit in this discussion. Folded filler sheet 12 is adapted to be modified to include image-receiving indicia. Image-receiving indicia included in this embodiment are in the form of, but not limited to slots 49, 51, 53, and 55 that when used together can hold a visual images 56 provided on a medium by the user. The steps required to make the modifications are outlined in instruction sheet 22. This method permits the visual image 56 to be easily removed and/or replaced. For visual image(s) 56 intended to be affixed using such slots, instruction sheet 22 directs the user to mark the location of the corners of visual image 56 on filler sheet 12, preferably with some sort of non-permanent marking device such as a pencil. Scissors or a sharp knife can be used to make cuts in the filler sheet 12 at the marked locations. When the corners of visual image 56 are inserted into slots 49, 51, 53, and 55, a portion of the visual image corner projects behind the image bearing surface of the filler sheet 12. To protect the corners of visual image 56 from being adhered to the non image bearing surface of the folded filler sheet 12 during lamination, voids 48, 50, 52, and 54 must be cut in the adhesive material 20. Once again, scissors or a sharp knife can be used to make the cuts. Once the modified adhesive material 20 is in place and the front and back sides are laminated together, slots 49, 51, 53, and 55 fall directly on top of adhesive voids 48, 50, 52, 54 producing a plurality of pockets for securely holding the corners of visual image 56. An alternate to forming the image-receiving indicia in the filler sheet 12, edge-receiving corner tabs (not shown) can be used. Edge-receiving corner tabs are a well-known method of affixing photographs into albums, and can be purchased in a variety of retail stores where photographic supplies are sold. Examples of such edge-receiving tabs are 3M's Photo fix™ and Lineco's Photo Mounting Corners.

Continuing with FIG. 2A, alternately image-receiving indicia such as a pocket 59 can be formed to hold a piece of memorabilia, for example a ticket stub. One way of making the pocket 59 is to cut a slot 57 in the filler sheet 12 wide enough to slip the ticket stub through. With the ticket stub now positioned in the slot, another adhesive void 58 can be located. Pocket(s) 59 are especially useful because many times memorabilia items contain information on both sides, and if the item were permanently affixed with adhesive, the user would loose the ability to view both sides. To assist the user in positioning the ticket stub on the filler page 12, service provider 96 can make a user defined indicia 66, in this case a low contrast reproduction of the ticket stub on the filler sheet 12, if the original ticket stub has been scanned by the user and uploaded to service provider 96. Scanning can be accomplished by the use of a flatbed scanner 93 such as the ScanJet 4C manufactured by the Hewlett-Packard Company and operably connected to a personal computer 88 as will be discussed in FIG. 4. Scanning of memorabilia can also be accomplished using a flatbed scanner 114 of kiosk 110 which will be discussed further with respect to FIG. 4 and FIG. 5.

Affixing user provided other visual images (not shown) to the laminated filler sheet 12 using appropriate adhesive such as photographic glue or double-sided tape completes the scrapbook page. Visual image 56 can be mounted at this time. This completed scrapbook page is an example of the folded filler sheet 12 having image-receiving indicia on the front and back surfaces.

Figure 2B:
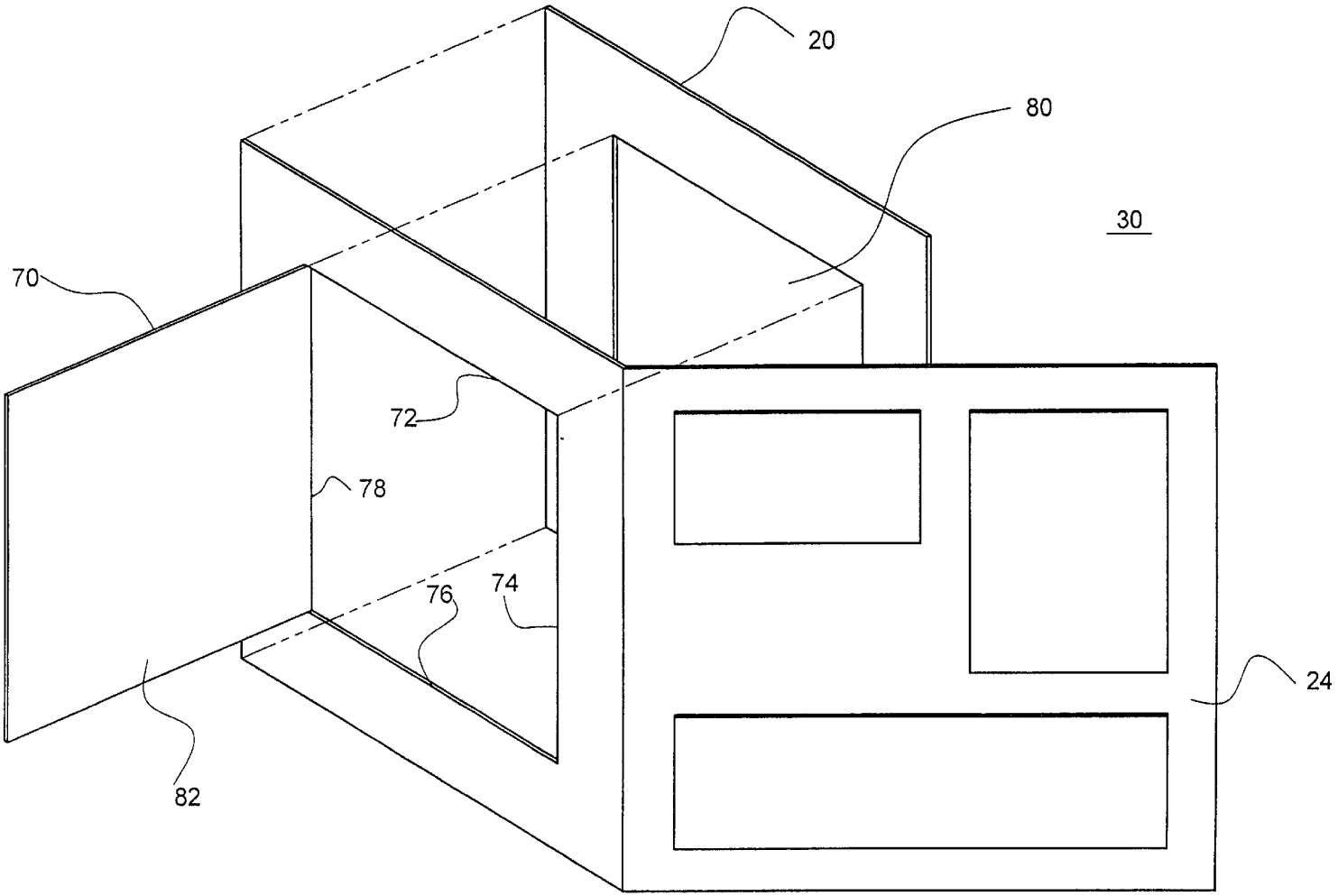
FIG. 2B depicts a step in the process of forming a laminated scrapbook page by providing a foldable flap on the filler sheet in kits made in accordance with the present invention.

FIG. 2B shows another partially finished laminated scrapbook page formed from either the first or second kits. We will now discuss in detail a method for finishing the laminated scrapbook page. For brevity, we will only consider the second kit in this discussion. Alternate image-receiving indicia such as a foldable flap 70 can be formed to hold additional visual images. Flaps can be formed on filler page 24 by cutting at least two sides of the filler sheet 12, and in one preferred arrangement along all but one side of a polygon, and making a fold along the remaining side. For example, to make flap 70, cuts 72, 74, and 76 are made in filler sheet 24, and then folded along side 78. Once flap 70 is formed, additional visual images can be affixed to a non-image bearing surface 82 of flap 70, as well as the image bearing surface (not shown) of the flap 70 and the non image-bearing surface of the corresponding back side adjacent to flap 70. To protect flap 70 from being adhered to the non image bearing surface of the folded filler sheet 24 during lamination, void 80 must be cut in the adhesive material 20. Scissors or a sharp knife can be used to cut void 80. Once the modified adhesive material 20 is in place and the front and back sides are laminated together, flap 70 falls directly on top of adhesive void 80 producing a feature onto which additional visual images (not shown) can be mounted.

Figure 3:
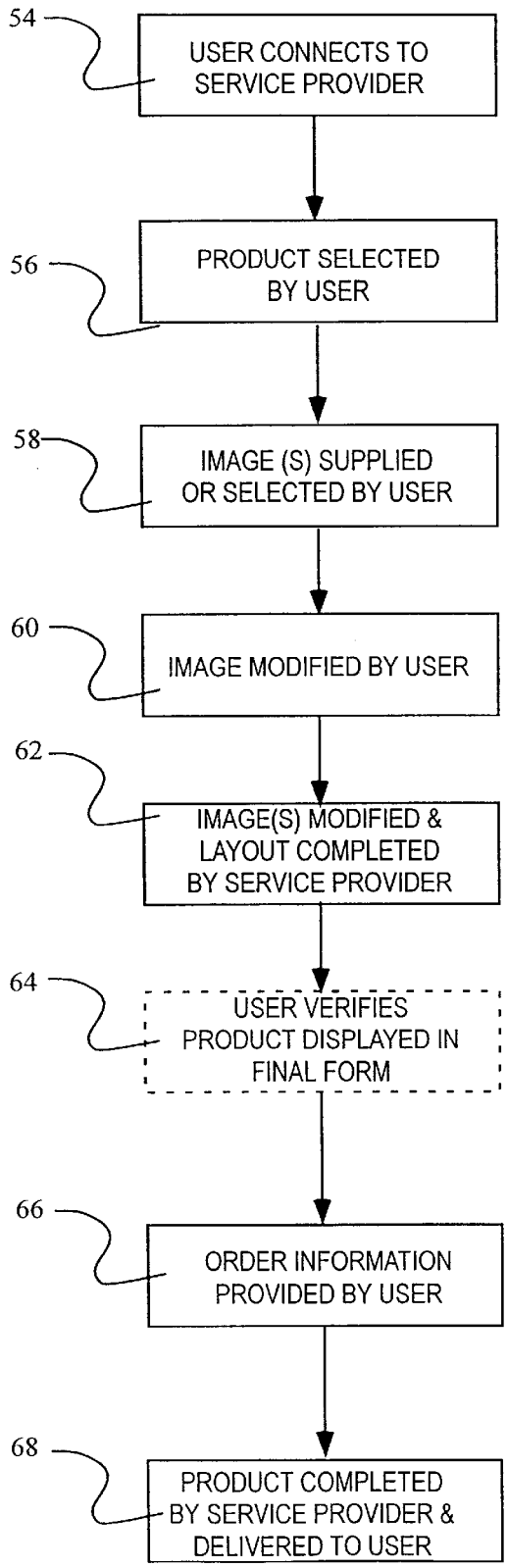
FIG. 3 depicts in block diagram form a flowchart which can be used to order a kit(s) that can be used to make a scrapbook page using the first or second kits.

FIG. 3 depicts flowchart which can be used to order kit(s) 10 or 30 that can be used to make a laminated scrapbook page. Users can order kits 10 or 30 from various locations providing the location has the appropriate equipment and the ability to electronically connect to a service provider. For instance, users can take advantage of this service from their home if they own a personal computer and have access to the Internet. Alternately, users can utilize the equipment at any number of retail locations having photo specialty products (see FIG. 6). Beginning with block 54, a user connects to a service provider 96 from computer 88 using a communication channel via an Internet Service Provider (ISP) 92 and Internet 94 (see FIG. 4) and selects (block 56) a product of interest such filler sheet 12. The service provider 96 will then prompt the user for the user supplied visual image(s) or user selected stock image(s) (block 58). If the user supplied visual image(s) exists in digital form, the user simply selects the file(s) that contain the image(s). If the visual image(s) exist in hard copy form, the user has the task of translating the visual image(s) into digital form. Scanning visual image(s) is one method, and can be accomplished using the flatbed scanner 93 (see FIG. 4). Once the visual image(s) are in digital form, the user can make modifications such as crop and red-eye removal (block 60). If the user selects to use stock image(s), the user simply selects the file(s) that contain the stock image(s). In block 60, the user uploads the image(s) (user supplied or stock) to service provider 96. Application server 100 (see FIG. 4) further modifies the image(s) if necessary (block 62). Before completing the order, the user can optionally view (block 64) the filler sheet 12 or 24 in its final form before supplying the appropriate user order information (block 66) such as credit card information and address information. Service provider 96 completes the order by printing the filler sheet 12 or 24, packaging it along with the adhesive sheet 20, instruction sheet 22, and alternate binder attachment 23 which is to be delivered (block 68) to the user at the address supplied in block 66.

Turning now to FIG. 4, a system 104 is shown which is useful in practicing the present invention as discussed with respect to FIG. 3. Personal computer 88 is shown operably connected to a server 98 of service provider 96 via a communication channel including ISP 92 and Internet 94 thus allowing a user to select products, supply digital images required for the fulfillment of the products, and supply order information required for the delivery of the completed product. Personal computer 88 is also shown operably connected to a printer 91 through a local channel that can be a cabled or a wireless channel. Printer 91 may be, for example, an inkjet printer, a thermal printer, or a silver halide printer.

An electronic camera 90 and scanner 93 are shown operably connected to personal computer 88 and can provide a source of user supplied visual images. Similarly, film images provided on a PictureCD™ manufactured by the Eastman Kodak Co. are another source of visual images, which have been converted to a digital format and are operable in personal computer 88 and useful in the present invention.

Service provider 96 includes server 98 which is responsible for connecting a user to application server 100 and collecting the order information used to complete the order and deliver the selected product. Application server 100 accepts the user supplied digital image and performs the necessary image processing to complete the ordered product such as the filler sheet 12 or 24. Communicating with a digital printer 102 such as a Model 2711 digital minilab manufactured by Noritsu Inc., Application Server 100 causes the digital printer 102 to print the filler sheet 12 or 24 with stock images 14, 16, and 18, or personalized background image(s) 26 which is then delivered to the user.

Figure 5:
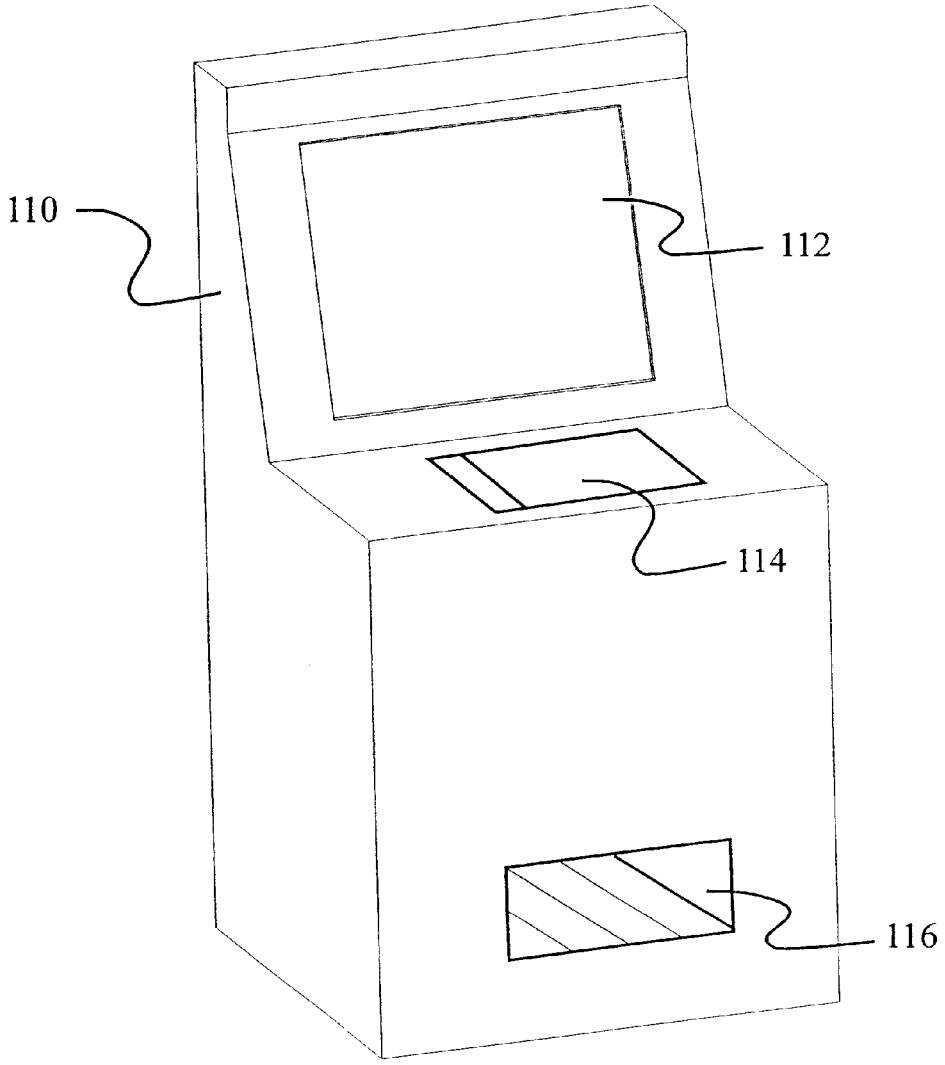
FIG. 5 depicts a picture or visual image making apparatus often referred to as a kiosk which can be used in making images for use in the present invention.

FIG. 5 shows another system which is useful in practicing the present invention as discussed with respect to FIG. 3. A picture or visual image making apparatus 110 can take various forms know in the art. For a specific example, it can be the Picture Maker™ kiosk produced by the Eastman Kodak Company. Picture or visual image making apparatus 110 includes a color display 112 for presenting information to a user and a flatbed scanner 114 for receiving the user supplied visual image 26 (not shown). Hardcopy egress slot 116 is provided for controlling the delivery of a print medium to a user.

Figure 6:
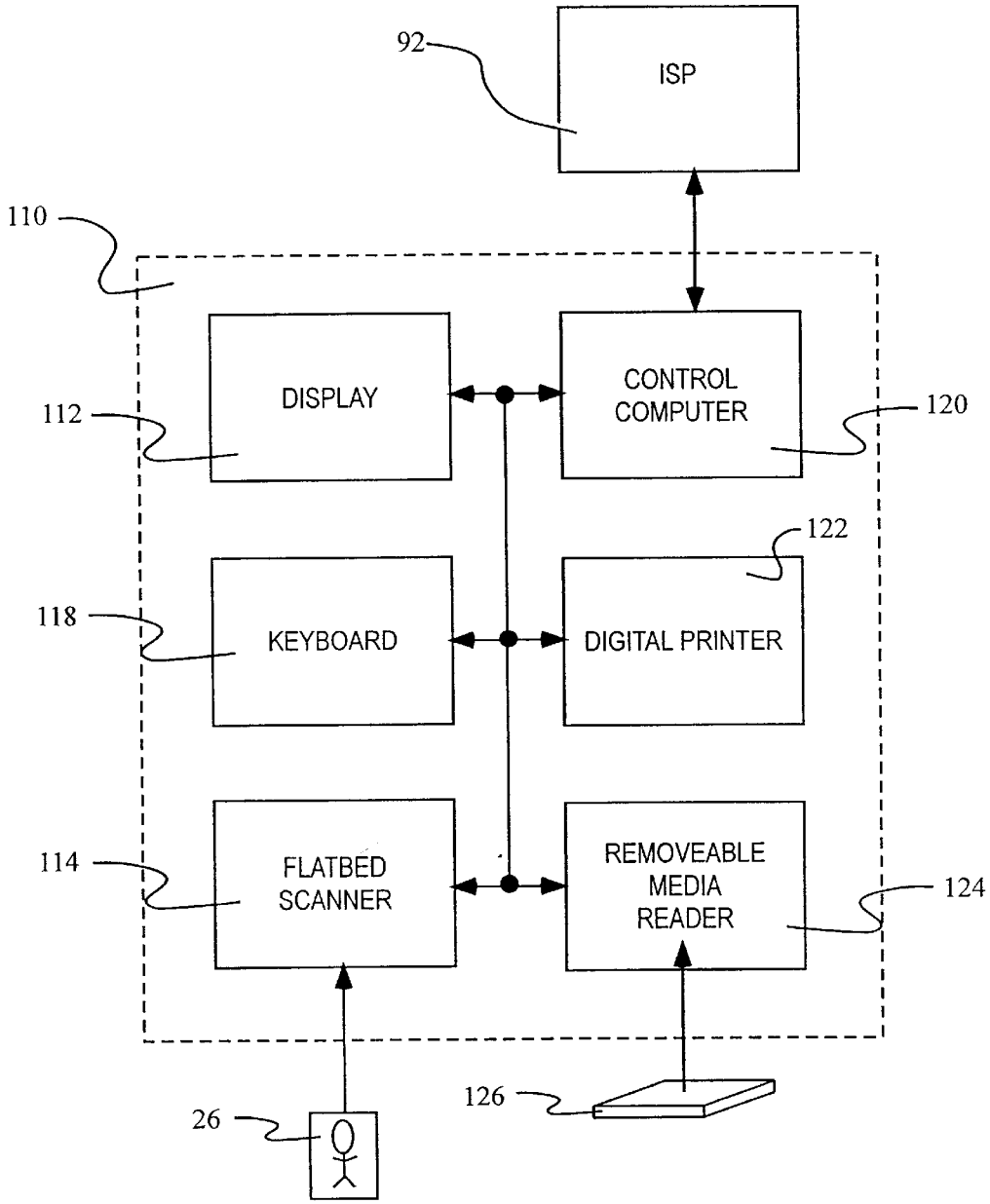
FIG. 6 depicts in block diagram form the various functions that are found in the picture or visual image making apparatus shown in FIG. 5.

Referring to FIG. 6, a block diagram is shown that depicts the included functions of the picture or visual image making apparatus 110 in more detail. Not shown in FIG. 5 is a keyboard 118 for entering information into a control computer 120. Control computer 120 typically is a specialized type of personal computer and manages the flow of information and functionality of the components of picture or visual image making apparatus 110. Control computer 120 is shown operably connected to a server 98 of service provider 96 via a communication channel including ISP 92 and Internet 94 (see FIG. 4). In addition to the flatbed scanner 114, another method for receiving the user supplied visual image 26 is illustrated by the inclusion of Removable Media Reader 124. Removable Media Reader 124 receives removable media 126 which can take many forms such as a compact flash card, a floppy disk, a compact disk, a PictureCD™ or many other forms of removable media used in transferring datafiles such as digital images.

Also internal to picture or visual image making apparatus 110 is a digital printer 122, an example of which is the Kodak Digital Science Model 8650 manufactured by the Eastman Kodak Company. The digital printer 122 responds to the commands of control computer 120 to print images on a medium such as thermal paper.

Figure 7:
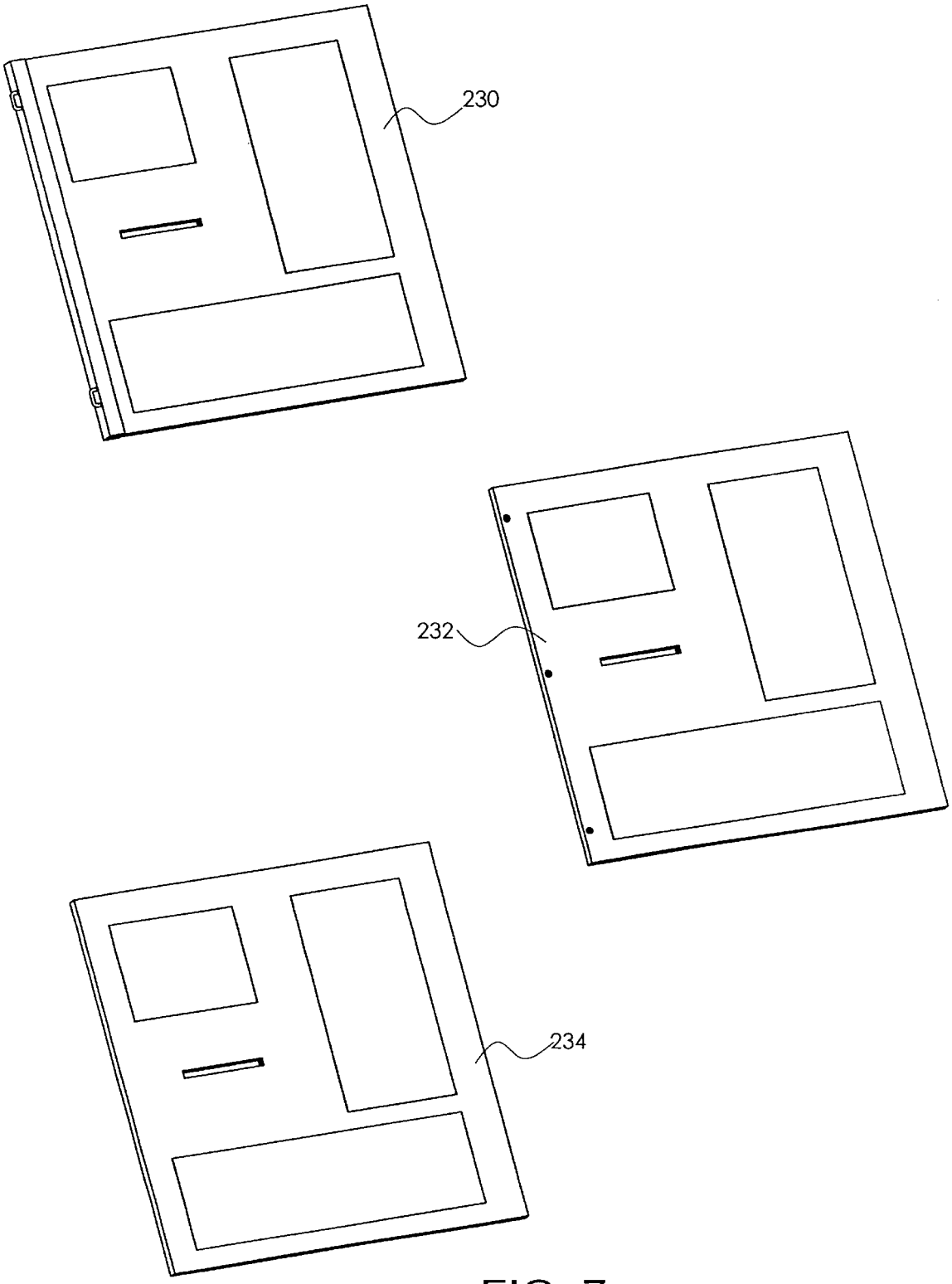
FIG. 7 depicts several finished scrapbook pages showing different binding embodiments.

FIG. 7 shows examples of the completed laminated scrapbook page (230, 232 and 234) having different binder attachments. 230 is an example of a completed laminated scrapbook page with the alternate binder attachment 23 mounted on one edge. This page will now fit into a scrapbook having a strap binding system. 232 is an example of a completed laminated scrapbook page having holes punched along one edge. This page will now fit into a scrapbook having a ring binding system. 234 is an example of a completed laminated scrapbook page which simply slides into a page protector. This page will now fit into a scrapbook having a post bound binding system.

The invention has been described in detail with particular reference to certain preferred embodiments thereof, but it will be understood that variations and modifications can be effected within the spirit and scope of the invention.

PARTS LIST

| | |
|---|---|
| 10 | first kit |
| 12 | filler sheet |
| 13 | fold line |
| 14 | stock image |
| 15 | image bearing surface |
| 16 | stock image |
| 18 | stock image |
| 20 | adhesive material(s) |
| 22 | instruction sheet |
| 23 | binder attachment |
| 24 | filler sheet OR filler page |
| 26 | personalized background image(s) |
| 28 | bearing surface |
| 30 | second kit |
| 48 | void |
| 49 | slot |
| 50 | void |
| 51 | slot |
| 52 | void |
| 53 | slot |
| 54 | void OR block |
| 55 | slot |
| 56 | visual image(s) |
| 57 | slot |
| 58 | block |
| 59 | pocket(s) |
| 60 | block |
| 62 | block |
| 64 | block |
| 66 | block |
| 68 | block |
| 70 | foldable flap |
| 72 | cuts |
| 74 | cuts |
| 76 | cuts |
| 78 | side |
| 80 | void |
| 82 | non-image bearing surface |
| 88 | personal computer |
| 90 | camera |
| 91 | printer |
| 92 | Internet Service Provider (ISP) |
| 93 | flatbed scanner |
| 94 | Internet |
| 96 | service provider |
| 98 | server |
| 100 | application server |
| 102 | digital printer |
| 104 | system |
| 110 | kiosk or visual image making apparatus |
| 112 | color display |
| 114 | flatbed scanner |
| 116 | hardcopy egress slot |
| 118 | keyboard |
| 120 | control computer |
| 122 | digital printer |
| 124 | Removable Media Reader |
| 126 | removable media |
| 230 | laminated scrapbook page |
| 232 | laminated scrapbook page |
| 234 | laminated scrapbook page |

What is claimed is:

1. A method of making a laminated scrapbook page, comprising the steps of:

a) providing a filler sheet which is adapted to be folded and laminated to provide the scrapbook page;

b) providing one or more visual images on at least one medium;

c) providing image-receiving slits associated with the filler sheet to be able to receive the visual image(s) on the medium by cutting portions of the filler sheet;

d) folding the filler sheet; and e) laminating the folded filler sheet with continuous adhesive material and providing voids in the adhesive material corresponding directly to the image-receiving slits and mounting the medium with the visual images in such image-receiving slits of the filler sheet to thereby provide the page of the scrapbook.

2. The method of claim 1 further including a binder attachment which is mounted on the filler sheet prior to insertion in a scrapbook.

3. The method of claim 1 further including providing visual images on the filler sheet.

4. The method of claim 3 wherein the visual images are formed from images provided over the internet and selected by a user.

* * * * *